US006318286B1

(12) United States Patent
Nakashima et al.

(10) Patent No.: US 6,318,286 B1
(45) Date of Patent: Nov. 20, 2001

(54) HULL SHAPE OF PERSONAL WATERCRAFT

(75) Inventors: Takehiro Nakashima, Akashi; Haruyoshi Maruyama; Mitsuhiro Yazaki, both of Kakogawa; Kanji Kiyohara, Akashi; Hisashi Fujii, Kobe, all of (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 09/497,952

(22) Filed: Feb. 4, 2000

(30) Foreign Application Priority Data

Feb. 5, 1999 (JP) ..... 11-028782

(51) Int. Cl.[7] ..... B63B 1/00

(52) U.S. Cl. ..... 114/271; 114/55.5; 114/56.1; 114/61.33

(58) Field of Search ..... 114/55.5, 61.33, 114/271, 288, 290, 291, 56.1

(56) References Cited

U.S. PATENT DOCUMENTS

| | | | | |
|---|---|---|---|---|
| 3,216,389 | * | 11/1965 | Thorsen | 114/290 |
| 3,363,598 | | 1/1968 | Mortrude | 114/290 |
| 4,128,072 | * | 12/1978 | Wood, Jr. | 114/291 |
| 4,492,176 | * | 1/1985 | Arima | 114/56.1 |
| 4,760,810 | * | 8/1988 | Kobayashi | 114/290 |
| 4,903,626 | * | 2/1990 | Haines | 114/56.1 |
| 5,063,868 | * | 11/1991 | Fink, Jr. | 114/291 |
| 5,170,735 | * | 12/1992 | Kobayashi | 114/271 |
| 5,351,642 | | 10/1994 | Ackerbloom | 114/290 |
| 5,588,388 | * | 12/1996 | Maruyama et al. | 114/271 |
| 5,983,823 | * | 11/1999 | Allison | 114/271 |
| 6,000,357 | * | 12/1999 | Allison | 114/271 |

FOREIGN PATENT DOCUMENTS

| | | |
|---|---|---|
| 51-45892 | 4/1976 | (JP) . |
| 55091480 A | 7/1980 | (JP) . |
| 1-94097 | 4/1989 | (JP) . |
| 7-215266 | 8/1995 | (JP) . |
| 7-329874 | 12/1995 | (JP) . |

* cited by examiner

*Primary Examiner*—S. Joseph Morano
*Assistant Examiner*—Lars A. Olson
(74) *Attorney, Agent, or Firm*—Marshall, Gerstein & Borun

(57) ABSTRACT

Provided is a hull shape of a personal watercraft which can enhance speed performance, and still more, can also reduce rolling of a body. A bulging face 12 is formed on an outside part of a rear portion of a hull bottom 20 having a substantially V-shaped cross section and protrudes downward from an outside front face 20*a* positioned in front of the outside part. The bulging face 12 includes a fore part 13 inclined downward in the rearward direction, and a rear part 14 positioned above a virtual face A extended rearwardly from the fore part 13.

5 Claims, 7 Drawing Sheets

HULL SHAPE OF PERSONAL WATERCRAFT

BACKGROUND OF THE INVENTION

1. Field of Invention

The present invention relates to a hull shape of a personal watercraft which can enhance speed performance and can reduce rolling of the watercraft.

2. Description of the Related Art

FIG. 7 shows an example of a hull shape of a conventional personal watercraft. The personal watercraft has a hull bottom 50 having a substantially V-shaped cross section. The hull bottom 50 is provided with a plurality of longitudinal strips 51. A rear portion of the hull bottom 50, which forms a planing face, is a smooth plane in a longitudinal direction.

With the above-mentioned shape of the hull bottom 50, however, an angle of planing trim might become smaller than an angle of design trim, or rolling might be generate at a specific speed, depending on a balance of weight and center of gravity or a distribution of an inclination angle (dead rise) of the cross section of the hull bottom in the longitudinal direction.

SUMMARY OF THE INVENTION

It is an object of the present invention to provide a hull shape of a personal watercraft which can enhance speed performance, and still more, can reduce rolling of the watercraft.

In order to attain the above-mentioned object, the present invention provides a hull shape of a personal watercraft comprising, a hull bottom having a substantially V-shaped cross section; and a bulging face formed on an outside part of a rear portion of said hull bottom, and protruding downward from an outside front face positioned in front of the outside part; wherein said bulging face comprises, a fore part inclined downward in the rearward direction, and a rear part positioned above a virtual face extended rearwardly from the fore part.

According to the above-mentioned structure, when the watercraft planes on a water, a water flow is turned downward by the fore part of the bulging face which is inclined downward in the rearward direction. Consequently, separation of the water flow is caused in the rear part provided above the virtual face rearwardly extended from the fore part so that a negative pressure is correspondingly generated. Thus, an attracting force is generated in the rear part, thereby lifting a stem. Consequently, an angle of planing trim of the watercraft is increased to approximate to an optimal angle of trim so that speed performance can be enhanced. The bulging face protrudes downward on the outside part of the hull bottom. Therefore, the negative pressure generated in this portion acts partly as a roll damping force, thus the rolling of the watercraft can be reduced. Since the area of the bulging face is restricted to the vicinity of a stern end, course stability is not impeded.

According to a preferred embodiment of the present invention, the front face in the vicinity of the bulging face and the rear part of the bulging face have a respective buttock line which is in parallel with a keel line as seen in a side view. The rear part of the bulging face is formed as a continuous plane which is bent from the fore part. Furthermore, the bulging face is formed between the longitudinal strip provided on the hull bottom to extend in longitudinal direction and a chine, i.e. the outer edge of the hull bottom.

These objects as well as order objects, features and advantages of the present invention will become more apparent to those skilled in the art from the following description with reference to the accompanying drawings.

DESCRIPTION OF THE PREFERRED EMBODIMENTS

An embodiment of the present invention will be described below with reference to the drawings.

Figure 1:
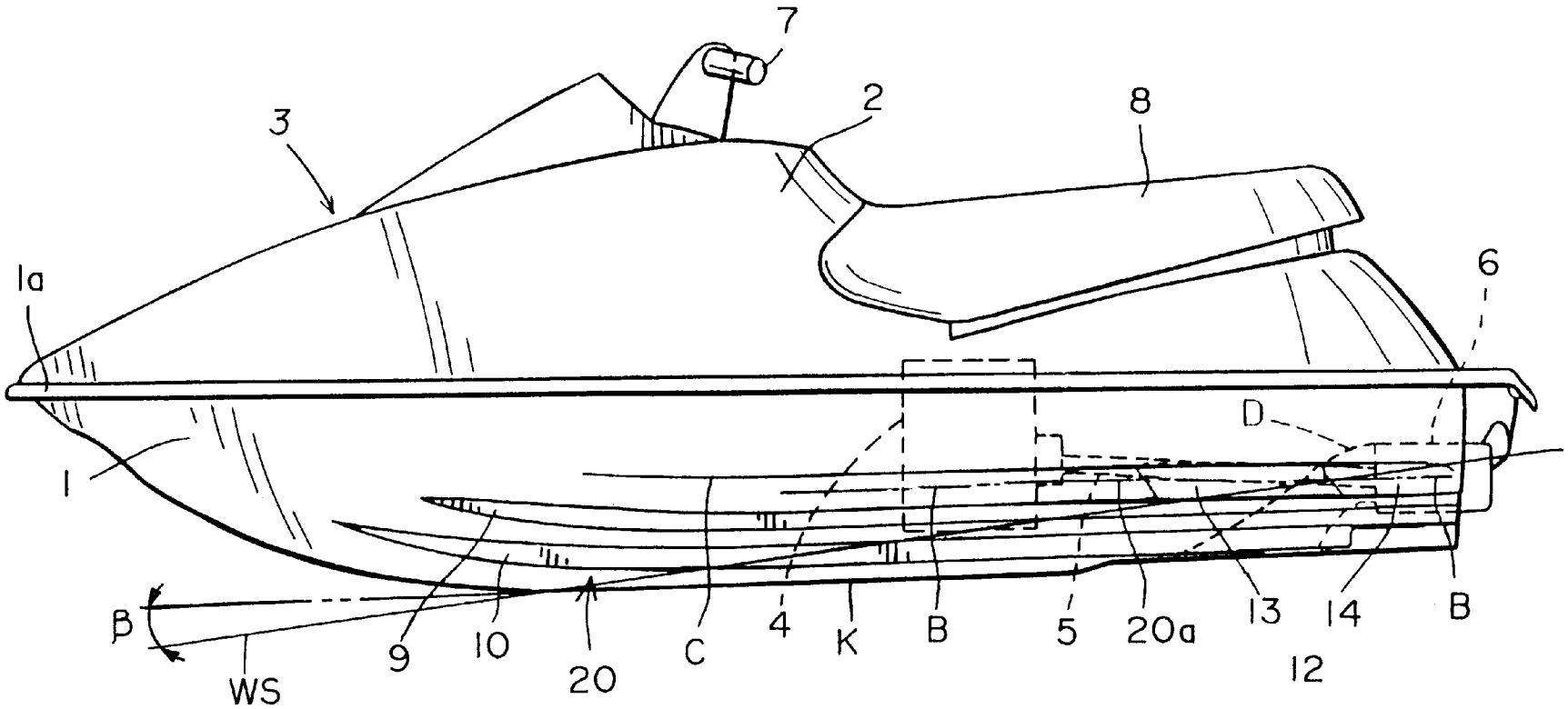
FIG. 1 is a side view showing a personal watercraft according to an embodiment of the present invention.
Figure 2:
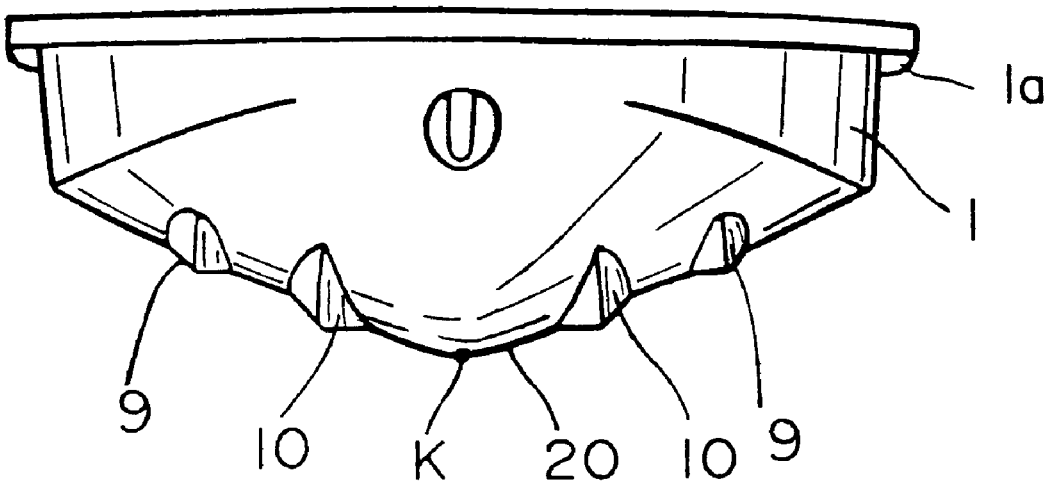
FIG. 2 is a front view showing a hull of the personal watercraft.

A personal watercraft shown in FIG. 1 has a body 3 formed by a hull 1 and a deck 2. The body 3 is provided with an engine 4 and a waterjet propulsor 6 being driven by a shaft 5 extended from the engine 4 therein. The propulsor 6 is mounted in a duct D provided on the rearward portion (stern) of the hull 1. The deck 2 is provided with a steering handlebar 7, a seat 8 on which a rider sits, and the like. A bottom 20 of the hull 1 has a substantially V-shaped cross section as shown in FIG. 2. The hull 1 and the deck 2 are molded by a synthetic resin respectively, and are integrally joined at a flange portion 1*a*, thereby forming the body 3.

Figure 3:
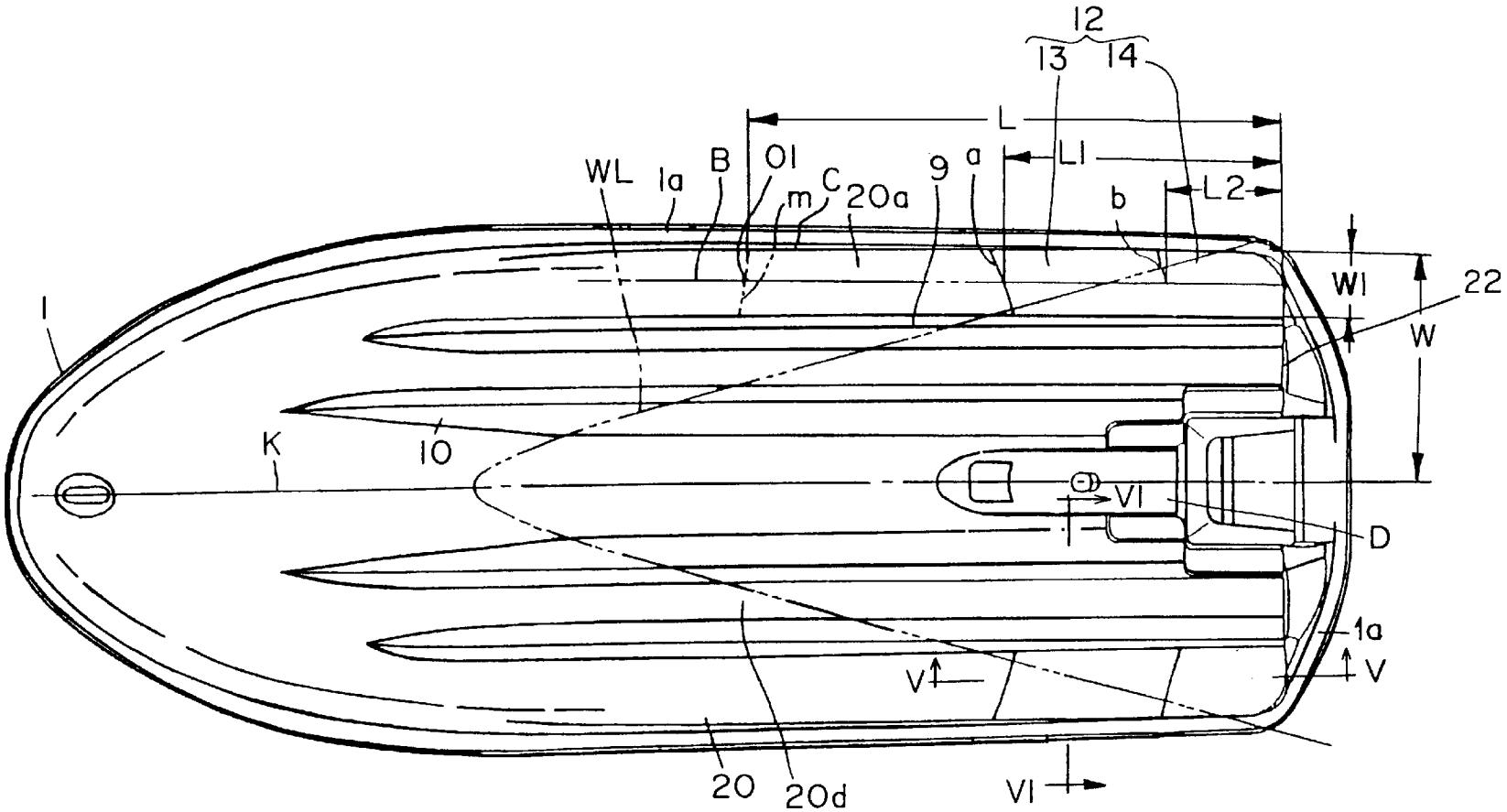
FIG. 3 is a bottom view showing the hull.

As shown in FIG. 3, first and second longitudinal strips 9 and 10 are provided in pairs on right and left sides of the hull bottom 20 arranged symmetrically on each side of a centerline extending in a longitudinal direction of the hull 1. The first and second longitudinal strips 9 and 10 are extended almost in parallel with a keel line K, and protruded from the hull bottom 20, respectively.

Figure 4:
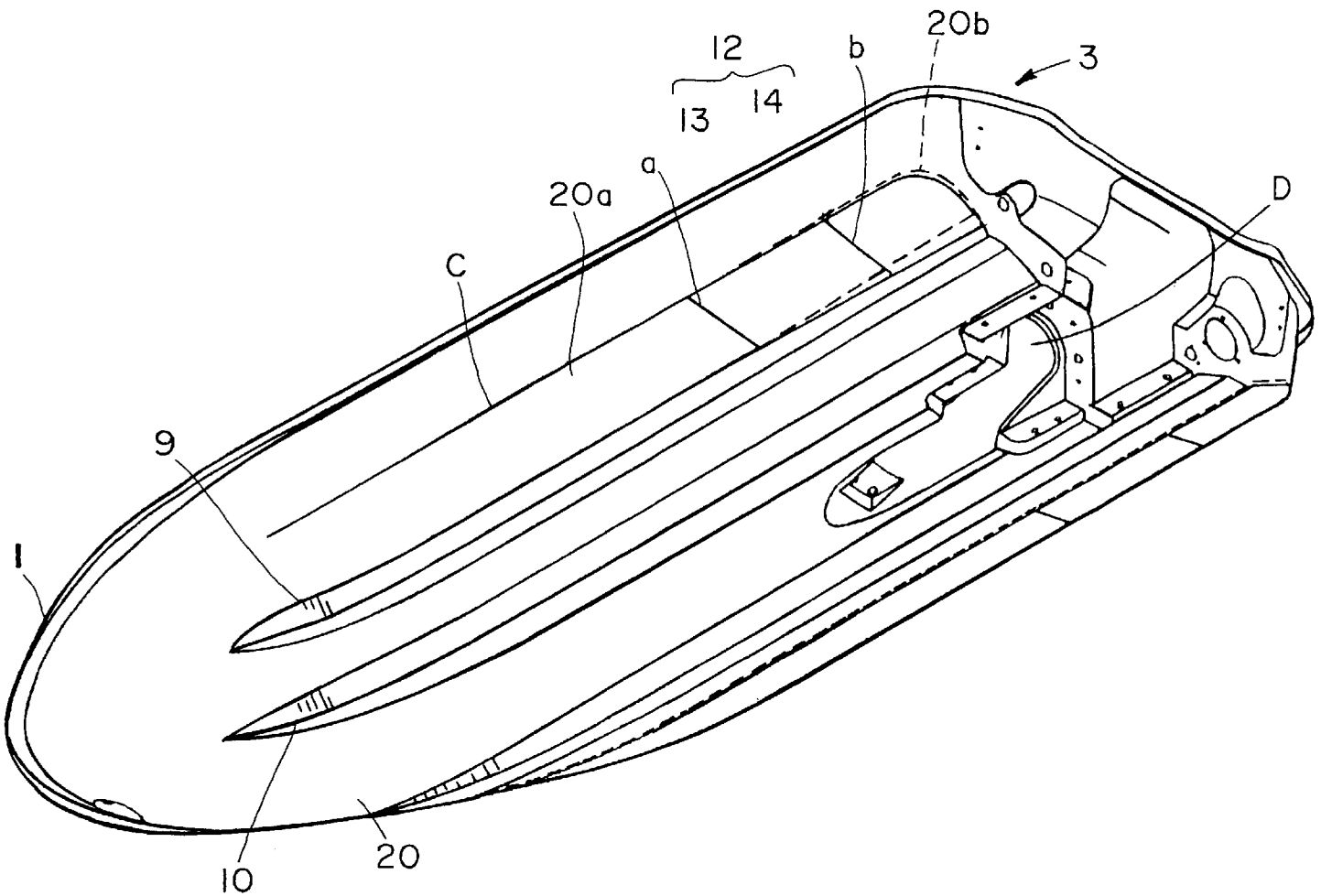
FIG. 4 is a perspective view showing a bottom of the hull.
Figure 5:
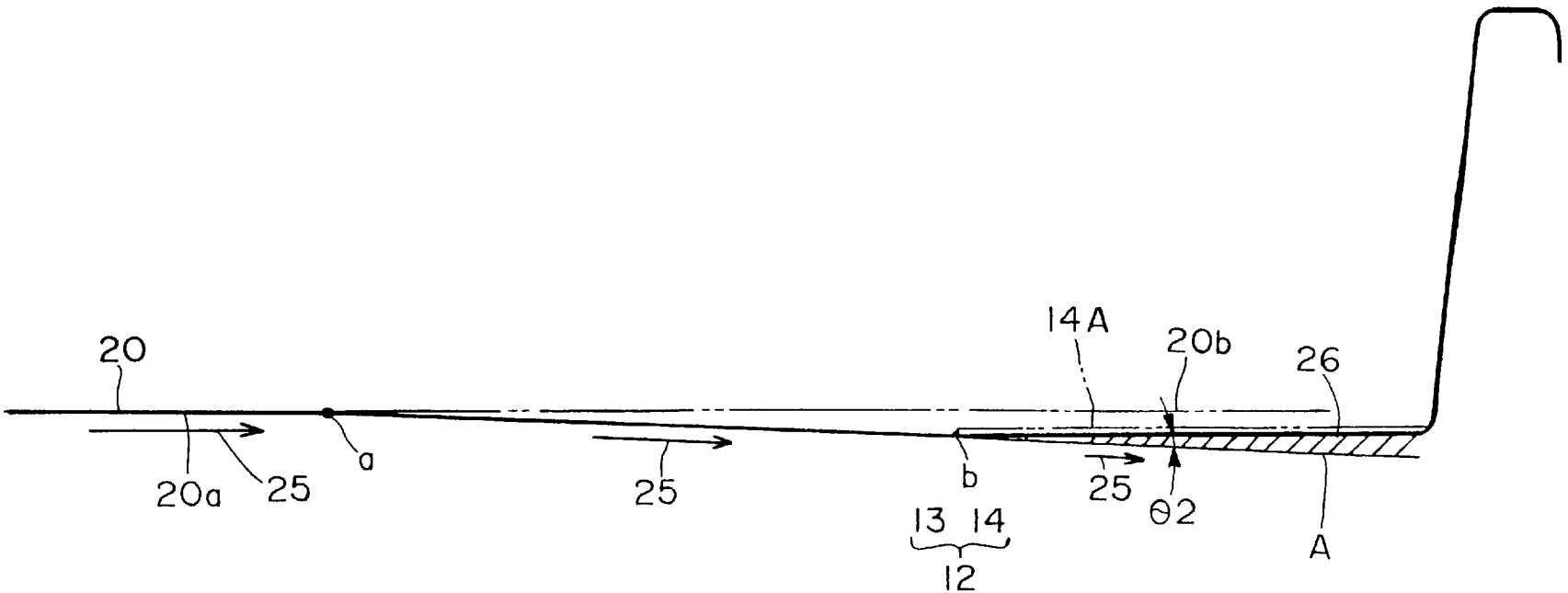
FIG. 5 is an enlarged sectional view taken along the line V—V in FIG.3.

As shown in FIG. 4, a bulging face 12 is formed on both rear outside portion of the hull bottom 20 between the first strip 9 positioned on the outermost side and a chine C, i.e an outer edge of the hull bottom 20. The bulging face 12 has a fore part 13 inclined downward in the rearward direction, and the rear part 14 positioned above a virtual face A (see FIG. 5) extended rearwardly from the fore part 13, and the fore part 13 and the rear part 14 are connected smoothly by bending without forming a step as shown in FIG. 5. Although the fore part 13 and the rear part 14 have been formed in a flat face, they may also be formed in a curved face. As shown in FIG. 4, the whole bulging face 12 protrudes downward from a virtual extended face 20*b*

(shown by a dotted line in FIG. 4) extended rearward from a front face 20*a* of the hull bottom 20 in front of a portion where the bulging face is to be formed.

In more detail, as shown in FIG. 5, the fore part 13 is inclined downwardly in the rearward direction from a first edge line "a", i.e. a boundary with the front face 20*a* at a predetermined angle θ1with respect to the front face 20*a*. In this case, the angle θ1 is 1 to 3 degrees, preferably 1.5 to 2.5 degrees. The rear part 14 is bent on a second edge line "b", i.e. a boundary with the fore part 13, and is inclined upwardly in the rearward direction at an angle θ2 with respect to the virtual face A extended rearwardly from the fore part 13. In this embodiment, the rear part 14 is set in parallel with the extended face 20*b* of the front face 20*a*.

Alternatively, the rear part 14 may be positioned above the extended face 20*b* through a step portion as shown by a virtual line 14A.

Furthermore, it is preferable that the bulging face 12 should be provided in a rear portion of the hull 1 in order to generate a stem lifting moment. In this embodiment, the rear part 14 is extended to the rear end of the hull. Accordingly, the fore part 13 and the rear part 14 are formed with respect to the hull bottom 20 as follows. Specifically, as shown in FIG. 3, a front edge of a portion formed by a flat plane on the front face 20*a* positioned in front of the bulging face 12, that is, an intersection line of a flat portion and a curved portion curved upward toward the front of the flat portion is represented as "m". If a distance from an intersection point O1, i.e. a crossing point of the front edge "m" of the flat portion and a buttock line B passing through the center of the bulging face 12 in a lateral direction (which is parallel with a keel line K seen in a plane view) to a rear edge 22 of the hull bottom 20 is represented as L. A position L1 of the first edge line a is set to (¼ to ¾) L apart from the rear edge 22, a position L2 of the second edge line b is set to (⅛ to ⅝) L, and a length (L1–L2) of the fore part 13 of the bulging face 12 is set to (⅛ to ⅝) L. When the watercraft planes at a full speed, a water line WL moves down to the level as shown by a twodot dashed line. Accordingly, a large part of the bulging face 12 is still included in a part of a planing face even when the watercraft is planing at a full speed. As the speed of the watercraft decreases, the water line WL moves forward, and then all the bulging face 12 is included in the planing face.

Furthermore, the bulging face 12 is arranged apart from the centerline of the body 3 on the outer side of the hull bottom 20 in order to reduce the rolling of the body 3. More specifically, it is preferable that a width Wl of the bulging face 12 seen from a bottom should be set to ⅕ to ⅖ of a half width W of the hull bottom 20 apart from the chine C which is an outer edge of the hull bottom 20*a*.

As shown in FIG. 1, furthermore, the front face 20*a* in the vicinity of the fore part 13 and the rear part 14 are formed in such a manner that the buttock lines B are set in parallel with the keel line K as seen in a side view.

The function of the above-mentioned structure will be described below. The hull 1 has a function to change the direction of a water flow 25 downward during planing by means of the downwardly inclined fore part 13 of the bulging face 12 provided on the hull bottom 20 as shown in FIG. 5. Consequently, separation of the water flow 25 is caused on the underside of the rear part 14, generating a negative pressure region 26. By the negative pressure, the rear part 14 is attracted to the water flow 25, and hence a stem is lifted up. Thus, an angle of trim β during highspeed planing shown in FIG. 1 (an angle formed between an aft straight line portion of the keel line K and a water surface WS) approximates to an optimal angle of trim, so that running resistance is reduced, resulting in an enhancement in speed performance.

Figure 6:
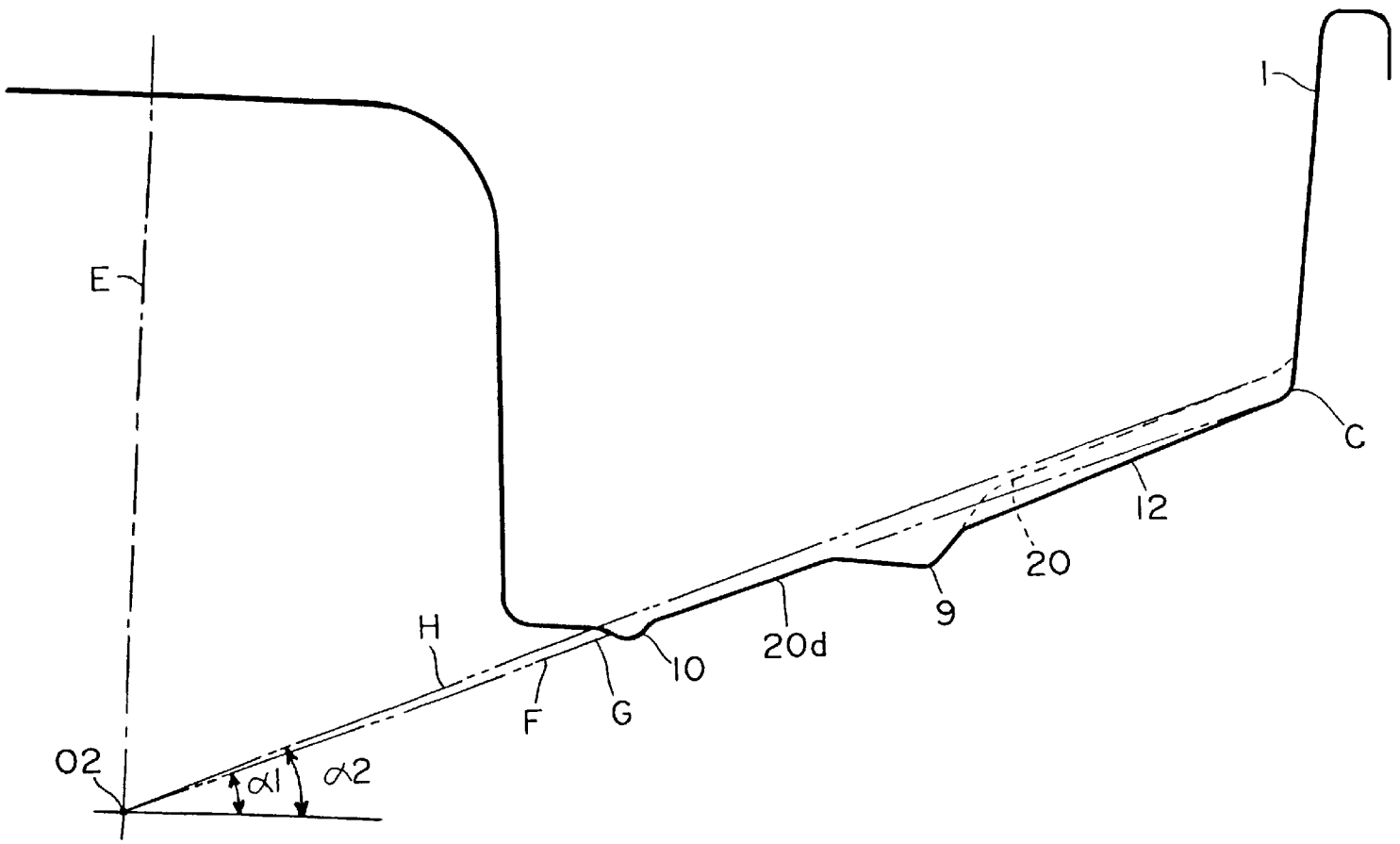
FIG. 6 is an enlarged sectional view taken along the line VI—VI in FIG.3.
Figure 7:
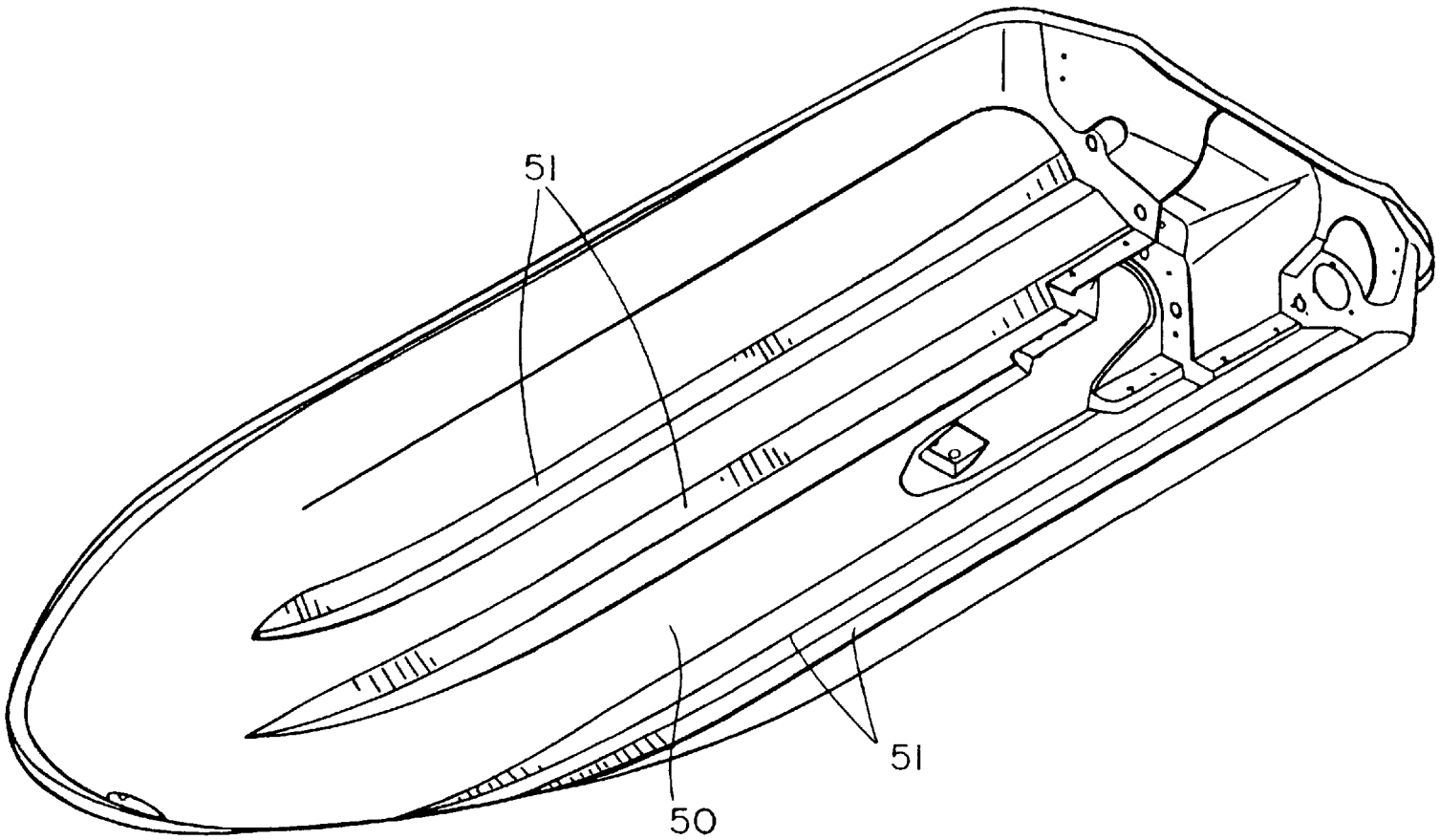
FIG. 7 PRIOR ART
FIG.7 is a perspective view showing a bottom of a hull according to the prior art.

The bulging face 12 protrudes downward on the outside part of the hull bottom 20 as shown in FIG. 3. Therefore, a V angle of the hull bottom 20 at the bulging face 12 becomes smaller than in the hull bottom of the conventional art. More specifically, as shown in FIG. 6, when an intersection point of a centerline E passing through the center of the hull 1 in a lateral direction and an extended line F of a central portion 20*d* on the inside of the first longitudinal strip 9 of the hull bottom 20 is represented as O2, and when a V angle of an outside hull bottom line G (which is coincident with the line F in this example) connecting the intersection point O2 with the periphery of the bulging face 12 (the chine C in this example) is represented as α1, and a V angle of an outside hull bottom line H connecting the intersection point O2 with the periphery of the hull bottom 20 having no bulging face 12 is represented as α2. Then the relation of the V angles $\alpha 1<\alpha 2$ is obtained, thus, by the reduction of the V angle, the rolling of the body 3 can be reduced.

The bulging face 12 is formed between the first longitudinal strip 9, i.e. the outer side strip on the hull bottom 20 and the chine C, i.e. the outer edge of the hull bottom. Therefore, the V angle (coincident with α1 in this embodiment) of the central portion 20*d* of the hull bottom 20 is identical to that obtained in the case where the bulging face 12 is not provided. Thus, course stability can be kept.

Furthermore, as shown in FIG. 5, the rear part 14 of the bulging face 12 is bent from the fore part 13 to form a continuous plane. There is no step portion between the parts 13 and 14. Therefore, the resistance of a fluid is not generated so that running performance can be maintained.

As shown in FIG. 1, each of the buttock lines of the part of the outside front face 20*a* in the vicinity of the fore part 13 and the rear part 14 is set in parallel with the keel line K as seen in a side view. Consequently, an angle θ2 of the rear part 14 (FIG. 5) which inclined upward in the rearward direction can be properly formed to cause stem lifting, thus, optimizing the angle of trim β.

Numerous modifications and alternative embodiments of the present invention will be apparent to those skilled in the art in view of the foregoing description. Accordingly, this description is to be construed as illustrative only, and is provided for the purpose teaching those skilled in the art the best mode of carrying out the invention. The details of the structure and/or function may varied substantially without departing from the spirit of the invention and all modifications which come within the scope of the appended claims are reserved.

What is claimed is:

1. A hull shape of a personal watercraft comprising:

a hull bottom having a substantially V-shaped cross section and an outside front face; and a bulging face formed on an outside part of a rear portion of said hull bottom and protruding downward from said outside front face positioned in front of the outside part;

said bulging face including a fore part inclined downward in the rearward direction and a rear part positioned above a virtual face defined as an extension rearwardly from the fore part.

2. The hull shape of a personal watercraft according to claim 1, wherein said outside front face in the vicinity of the bulging face has a buttock line parallel to a keel line when seen in a side view and the rear part of the bulging face along the buttock line is parallel with the keel line when seen in the side view.

3. The hull shape of a personal watercraft according to claim 1, wherein the rear part of the bulging face is a continuous plane which is bent from the fore part.

4. The hull shape of a personal watercraft according to claim 1, further including a longitudinal strip extended in a longitudinal direction of the hull, a chine formed as the outer edge of the hull bottom, the bulging face being formed between the longitudinal strip and a chine.

5. The hull shape of a personal watercraft according to claim 4, said rear part of the bulging face being extended to the rear end of the hull.

* * * * *